US006364031B1

(12) United States Patent
Amicangelo

(10) Patent No.: US 6,364,031 B1
(45) Date of Patent: Apr. 2, 2002

(54) ROD DRIVING AND EXTRACTING TOOL AND METHODS

(76) Inventor: Louis A. Amicangelo, 5859 Ely Rd., Wooster, OH (US) 44691

( * ) Notice: Subject to any disclaimer, the term of this patent is extended or adjusted under 35 U.S.C. 154(b) by 0 days.

(21) Appl. No.: 09/422,603

(22) Filed: Oct. 21, 1999

(51) Int. Cl.[7] ..... B25D 1/00; E02D 7/04

(52) U.S. Cl. ..... 173/90; 173/91; 81/20; 254/30

(58) Field of Search ..... 173/1, 90, 91, 173/29, 115, 129, 126; 227/147; 254/30, 29 R, 131, 132; 81/26

(56) References Cited

U.S. PATENT DOCUMENTS

| | | | | | |
|---|---|---|---|---|---|
| 1,916,463 | A | * | 7/1933 | Carrel | 254/132 |
| 2,629,985 | A | * | 3/1953 | McDowell | 173/91 |
| 2,988,087 | A | | 8/1961 | Iddings | 450/81 |
| 3,234,981 | A | * | 2/1966 | Finke | 81/26 |
| 3,381,763 | A | * | 5/1968 | Matson | 173/91 |
| 3,786,847 | A | | 1/1974 | Schera, Jr. | 173/90 |
| 3,991,976 | A | * | 11/1976 | Skinner | 254/30 |
| 4,315,551 | A | | 2/1982 | Iannone | 227/147 |
| 4,487,273 | A | | 12/1984 | Smolyanitsky et al. | 173/55 |
| 4,557,409 | A | | 12/1985 | Hecock et al. | 173/91 |
| 4,641,715 | A | | 2/1987 | Stinson et al. | 173/90 |
| 4,790,392 | A | * | 12/1988 | Clements | 173/90 |
| 5,010,710 | A | | 4/1991 | Gray et al. | 173/90 |
| 5,025,867 | A | * | 6/1991 | Muller | 173/90 |
| 5,029,427 | A | | 7/1991 | Jewett | 52/749.1 |
| 5,052,659 | A | * | 10/1991 | Bates | 254/29 R |
| 5,086,849 | A | | 2/1992 | Dahl | 173/90 |
| 5,167,288 | A | | 12/1992 | McNeil et al. | 173/129 |
| 5,174,386 | A | | 12/1992 | Crover | 173/53 |
| 5,174,388 | A | | 12/1992 | Williams et al. | 173/1 |
| 5,248,002 | A | | 9/1993 | Williams | 173/1 |
| 5,265,466 | A | | 11/1993 | Richter et al. | 405/184 |
| 5,337,836 | A | | 8/1994 | Williams | 173/90 |
| 5,368,277 | A | * | 11/1994 | Moss | 254/30 |
| 5,462,126 | A | | 10/1995 | Wallace | 173/90 |
| 5,713,559 | A | | 2/1998 | McClarin et al. | 254/30 |
| 5,794,918 | A | * | 8/1998 | Price | 254/30 |
| 5,863,154 | A | | 1/1999 | Olsen | 405/232 |

OTHER PUBLICATIONS

Harger Lightning Protection, Inc., Ground Rod Driver Sleeves, www.harger.com p. 1 of 1 Jul. 27, 1999.

The REM Drive, REMDistribution, Inc. and Dark Horse Design, 1999, www.ground–rod–driver.com 2 pages Jul. 27, 1999.

Bosch 11311EVS Demolition Hammer, www.coastaltool-.com p. 1 of 1 Jul. 27, 1999.

DeMark Ground Rod Drivers, demrk.com 2 pp. Jul. 27, 1999.

* cited by examiner

*Primary Examiner*—Scott A. Smith
(74) *Attorney, Agent, or Firm*—Calfee, Halter & Griswold, LLP

(57) ABSTRACT

A rod driving and extracting tool having a head connected to a handle is provided. The tool has two ends, each of which has an open bore, or rod-receiving end for communicating a section of a rod to be driven through either a first or second hollow handle section, respectively. The first and second hollow handle sections each have a second end forming a rod driving surface disposed in the handle. The first and second rod driving surfaces are on opposite sides of a generally solid, rod driving section interposed between the first and second hollow handle sections. The head has at least one additional driving surface in the form of a striking face. A rod extraction tool in the form of a cross-wise hole through the handle is provided in the solid rod driving section. Methods of using the tool to install a rod or to extract a partially exposed rod, are provided.

17 Claims, 3 Drawing Sheets

ROD DRIVING AND EXTRACTING TOOL AND METHODS

BACKGROUND OF THE INVENTION

The subject invention is directed to the art of driving rods into the ground and extracting rods from the ground. More particularly, the invention concerns a rod driving tool having three or more driving, or rod end impacting, means; two carried within the handle of the tool and at least one more driving means on the head of the tool. Additionally, the invention concerns an extractor tool carried by the handle of the rod driving tool.

Long rods are driven into the ground for a variety of reasons. Concrete reinforcing bar, or rebar, is often driven into the ground at the beginning of construction projects, such as in building, bridge, or silo construction. Utility company personnel drive ground rods into the earth for fault control and to prevent unwanted voltage fluctuations to power distribution systems. Electrical contractors also drive highly conductive electrical grounding rods into the ground to provide proper grounding for all electrical services. Metal building contractors drive ground rods every 100 lineal feet to provide building bonding and grounding as per the National Electrical Code. Fence builders drive rods into the ground and, in the case of electrical fences, also drive ground rods into the ground. Lightning contractors use electrical grounding rods as a means of protection from lightning strike damage. Computer, data and security systems require proper grounding if not already provided by the main electrical service.

These rods are often made of a steel and may be coated with a more highly conductive coating. They may have a pointed end to assist with ground insertion and driving, and a flat end for being struck. They are typically driven by a person swinging a sledge hammer while another person holds the rod in the desired location and to keep it steady. As these rods are often eight feet long, or longer, one or both of the people may be on ladders, or atop some other object, to be elevated to a position where the rod can effectively be struck and driven. At a new building construction site, where such installations often take place, the ground may be uneven or soft, thereby making ladder placement and use both difficult and dangerous for either or both persons. In addition, by requiring two people to drive a given rod into the ground and having one or both of them need ladders to be able to strike the rod end with the sledge hammer adds significant time and expense to any given rod installation.

In addition to being more timely and costly, rod installation in this manner with two people can be dangerous. The person swinging the sledge hammer sometimes misses the mark, either completely, or partially, thereby resulting in a glancing blow with a dangerous deflecting sledge hammer head. The person holding the rod can be injured by a direct impact on the hands or arms with a missed swing of the hammer, or they can be struck elsewhere on their person by the deflected hammer head. Also, since grounding rods are typically driven into the earth close to buildings, the building could be damaged by the glancing sledge hammer head breaking windows or causing other damage.

Another serious problem that often occurs with driving a rod into the ground by repeatedly impacting an end of the rod with a sledge hammer is that the rod may become damaged. The rod end may become deformed or the rod may be bent due to an off center and non-square impact with a hammer face of the sledge. When driving electrical grounding rods, for example, deformed, or even mushroomed, rod ends do not allow electrical grounding connectors to be slipped over the rod end. These rods have to have their ends re-worked. Typically, this may be done by filing down the deformed end in place so that the connector will slide on. In severe cases, the rod must be dug out and scrapped, a further time-consuming and costly measure. Bent rods are similarly scrapped.

A number of rod driving devices are known that overcome some of the problems with driving rods using sledge hammers. Among these, U.S. Pat. No. 5,086,849 to Dahl discloses a rod driving tool formed of three tightly bundled tubular members having a common upper elevation. Use of the device to drive a rod into the ground is done in steps. The device requires use of a separate extension piece to fully drive a rod into the ground. Although this tool is disclosed to permit rod installation by one laborer, it is disclosed to be lengthy and requiring a separate piece, an extension element, to drive the rod all the way to the surface level.

U.S. Pat. Nos. 5,248,002 and 5,337,836 to Williams disclose a tool and method, respectively, to drive a rod into the ground. The device has a handle with a bore opening for receiving a rod, a hammer head connected to the handle at the opposite handle end to the bore opening and a removable weight connected with the hammer head. The removable weight is connected to the hammer head via a bolt that passes through the weight and into the hammer and at least one pin inserted in corresponding apertures in the weight and in the hammer head. The weight has an aperture in an end face of it for placement over a partially installed rod. The opposite end face of the weight then acts as a striking surface for the hammer, thereby allowing a partially installed rod to be further driven into the earth. Again, this tool is disclosed to permit rod installation by one laborer, however, it too has multiple pieces that can be easily lost. In addition to requiring multiple pieces, the disclosed tool requires the user to start a rod by holding the handle and balancing the weighty hammer head with additional weight attached in the cumbersome starting position, well over their head. This can be awkward and make angled rod insertions difficult.

Another rod driving tool said to permit a single laborer to install a rod while standing on the ground is disclosed in U.S. Pat. No. 4,557,409 to Hecock et al. This device is cylindrical and has hammers secured at each end. Either hammer can be brought to selectively impact with a single anvil connected to a drive shaft that has a recess to slide over a rod end to be driven. The outer cylinder with hammers and the drive shaft with anvil are two separate pieces. The device works as a slide hammer with the outer cylinder lifted with respect to the drive shaft and brought down to impact either hammer, as selected, with the anvil to drive the rod. The device has locking means in the form of a pin and corresponding openings to secure the two pieces together in a storage position.

SUMMARY OF THE INVENTION

The invention allows a single user to drive a long rod, such as an eight foot electrical grounding rod, into the ground while standing firmly on the ground with a single, affordable manual tool. The tool requires no separate pieces that can be lost, nor does it have any moving parts that can wear, become dirty and jam. The tool of the present invention contains at least three rod-driving means, typically used for starting, intermediate and final installation of a rod, respectively. The tool includes a handle connected to a head. The handle includes two of the rod-driving means contained within it. The handle has rod-receiving bore openings at each of the two handle ends, each of which communicates through a corresponding hollow handle section to a respective striking surface disposed within the handle somewhere between the two handle ends. The head contains the third driving means in the form of a striking face, such as a hammer face. Of course, as is the case with a sledge hammer head, the head may have more than one striking face and still be within the present invention. Additionally, rod extractor means in the form of a hole cross-wise through the handle and sized to slip over a rod end and at least a section of the rod to be extracted, and used to pry the rod up from the ground, are carried by the rod driving tool in an embodiment of the present invention. The invention also concerns methods of using such an inventive tool to drive a rod into the ground and, in an embodiment of the tool, to extract a rod from the ground.

In one embodiment, the first hollow handle section is longer than the second hollow handle section and includes the handle end connected with the head. The worker slides the rod end to be impacted through the rod receiving opening of the first hollow handle section and the head. The head may resemble a sledge hammer head having two striking faces, for example, and may be similarly weighted. The worker then places the other rod end at the desired installation location and angle in contact with the ground. The rod does not have to be driven vertically, but can be installed at an angle, as desired, with the inventive tool. The worker may grasp the head or the handle of the tool and lift the tool with respect to the rod so that a portion of the first hollow handle section still surrounds the rod. Lifting the tool with respect to the rod in this inventive embodiment is relatively easy and controllable, since the head forms the majority of the tool overall weight and is near the worker's own head when impacting the rod end while vertically inserting an eight foot standard length grounding rod, for example. To drive the rod the worker then forcefully brings the tool down so that the striking surface at the end of the first hollow section within the handle impacts the rod end, thereby driving the rod into the ground. This process is repeated until the rod is partially installed as desired. The rod can be inserted using the first drive means such that the exposed portion of the rod above ground surface level is limited by the length of the first hollow handle section.

At this point, the worker removes the tool from surrounding engagement with the rod and slides the second rod receiving opening at the opposite handle end over the rod so that a portion of the rod is surrounded by the second hollow handle section. The worker can then hold the handle or the head of the tool, now with the head at a vertically higher elevation of the tool such that it is above the rod end within the tool handle, and similarly drive the rod with the corresponding striking surface at the end of the second hollow handle section impacting the rod end. In this manner, the heavy head of the tool is at a manageable elevation, typically near or below a standing worker's head level. The worker can drive the rod in this manner up to or beyond the limit of the second hollow handle section hitting the ground. The second hollow handle section can be driven, with the rod into the ground to fully drive the rod, in some installations.

If needed, final installation of the rod may be made with the tool used as a conventional hammer, with the worker holding the handle and swinging the head down to impact the rod end with the striking face of the head, thereby driving the rod down into the ground as desired.

A tool user can selectively use any of the at least three driving means as desired, the choice typically depending on whether the user is starting to drive a rod into the ground, driving a partially installed rod into the ground, or finishing the driving of the rod into the ground. In the event a partially installed rod needs to be removed, such as when it is discovered the rod is not in the correct location or when a subsurface blockage is encountered preventing further installation, an embodiment of the tool provides integral rod extractor means. The rod extractor takes the form of a hole cross-wise through the handle. In one embodiment, the extractor hole is through a solid section of material within the handle that serves to also form the first and second striking surfaces on its ends within the first and second hollow sections of the handle. A user turns the tool horizontal and slides the extractor hole of the tool over the exposed rod end of the partially installed rod until the tool is in contact with the ground at both the head and opposite handle end. The user then lifts one end of the tool with the other end contacting the ground as a pry surface. The extractor hole grips and lifts the rod. This process may have to be repeated, as desired, to extract the rod as needed. In the embodiment of the tool with the longer first hollow handle section having an end connected with the head and an extractor tool interconnected between its other end and a shorter second hollow handle section, extracting a rod would preferably be done by lifting the head end of the tool, thereby benefiting from the larger moment arm.

BRIEF DESCRIPTION OF THE DRAWINGS

The invention may take physical form in certain embodiments and methods which will be described in detail in this specification and illustrated in the accompanying drawings which form a part hereof, and wherein.

DETAILED DESCRIPTION OF THE PREFERRED EMBODIMENTS

Figure 1:
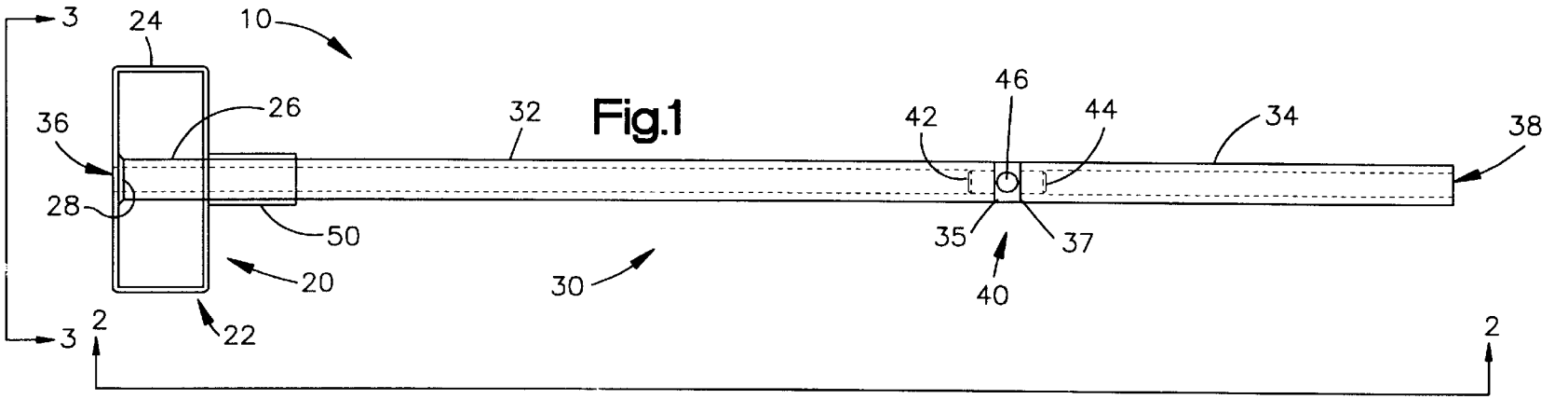
FIG. 1 is a partial sectional, perspective view illustrating an embodiment of a rod driving tool of the present invention including extractor means.
Figure 2:
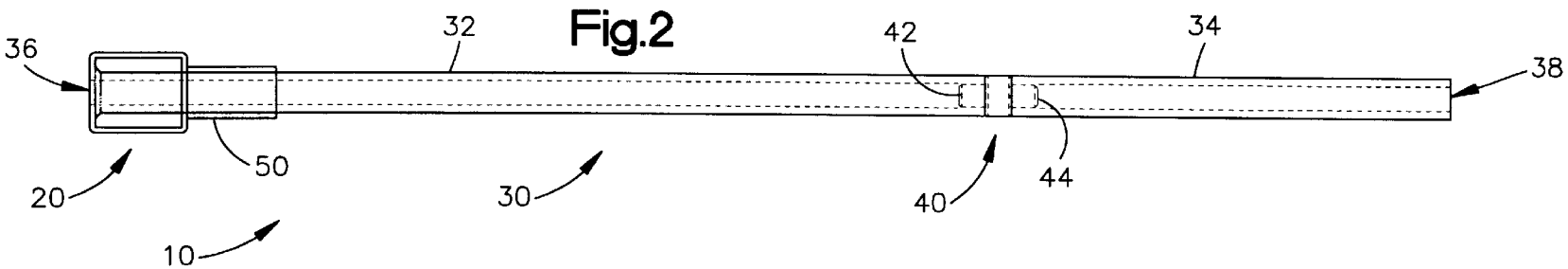
FIG. 2 is a view of the tool of FIG. 1 taken along line 2—2.
Figure 3:
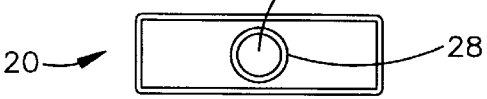
FIG. 3 is a view of the tool of FIG. 1 taken along the line 3—3.

Referring now to the drawings wherein the showings are for the purposes of illustrating preferred embodiments of the invention only and not for purposes of limiting same, FIGS. 1, 2 and 3 illustrate an embodiment of the rod driving tool 10 of the present invention. Tool 10 is shown comprising a head 20 connected to a handle, shown generally at 30. Head 20 has at least one striking face. In the illustrated embodiment, head 20 resembles a sledge hammer head and has two striking faces 22 and 24, one each at opposite ends of head 30. Of course, a sledge hammer-like head having two striking faces, such as 22, 24 shown, is not required for the inventive tool. A head (not shown) having only one striking face and connected with the handle at an edge and not through a bore in the head (as is shown in FIGS. 1–3) would suffice and is within the scope of the present invention.

The tool handle 30, shown in FIGS. 1 and 2, includes a first hollow handle section 32 and a second hollow handle section 34. A generally solid rod-driving section, shown at 40, is interconnected between hollow handle sections 32 and 34. The first hollow handle section 32 has a first open, or bore, end 36 for receiving a rod therethrough to be driven into the ground (see rod 62 in surrounding engagement with hollow handle section 32 of tool 10 in FIG. 4). Near the second, opposite end 35 of hollow handle section 32 is the first striking surface 42 of the rod driving section 40 for impacting a rod end through hollow handle section 32. Handle 30 has a second hollow handle section 34 similarly having a first open, or bore end, 38 and a second opposite end 37. Near end 37 and interiorly communicating with second hollow handle section 34 is the second rod striking surface 44 of the rod driving section 40.

Figure 4:
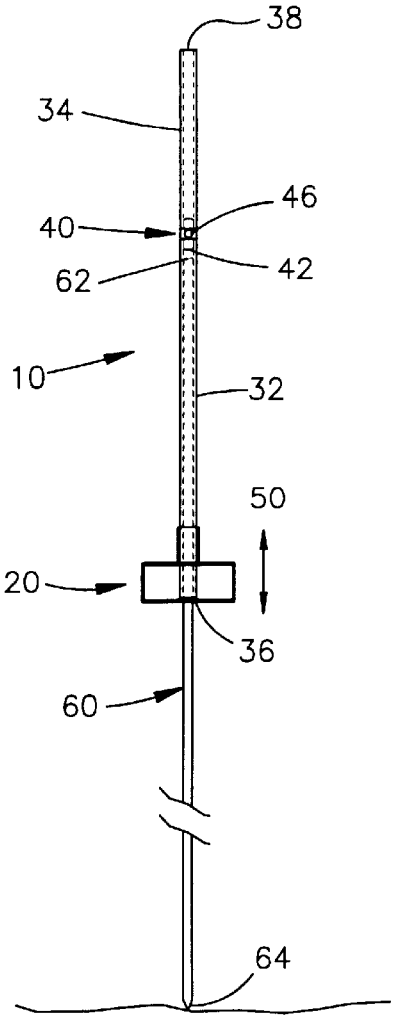
FIG. 4 illustrates an embodiment of the tool of the present invention with a rod in the position for initial installation and the worker not shown.
Figure 5:
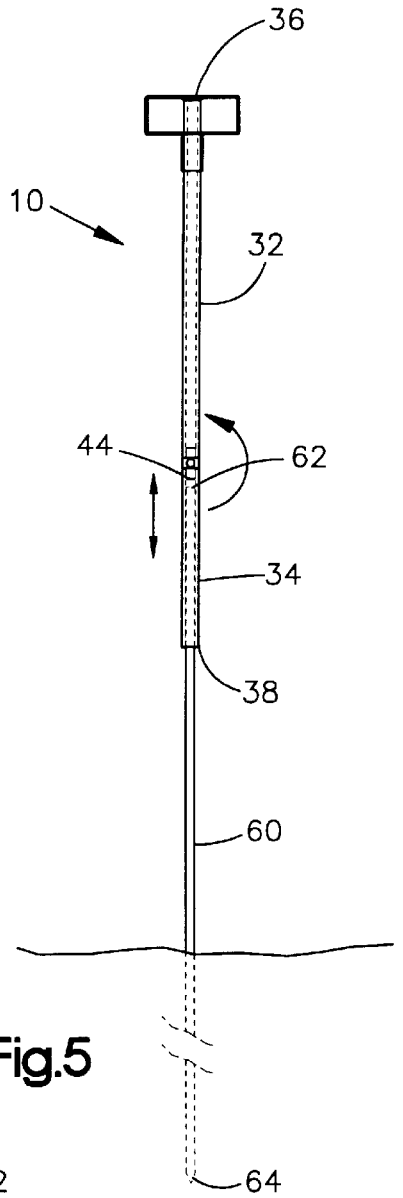
FIG. 5 illustrates an embodiment of the tool of the present invention in use with a rod already partially installed into the ground and now being further installed, with the worker not shown.
Figure 5B:
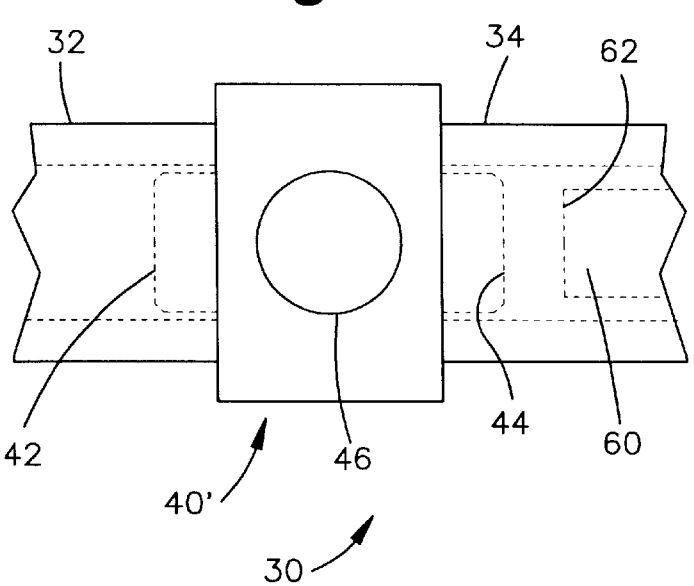
FIG. 5B is a similar view to FIG. 5A, but showing an alternative embodiment of a larger rod driving section 40 with an extractor tool 46.
Figure 5A:
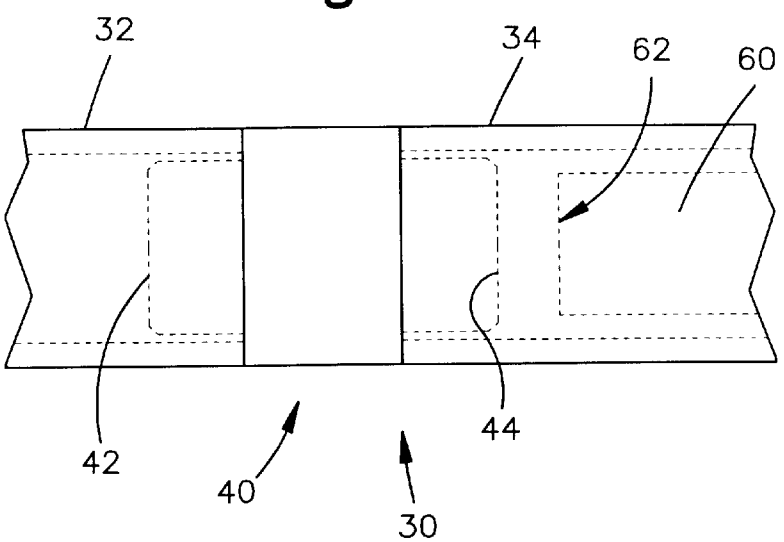
FIG. 5A illustrates a close up of the section 5A in FIG. 5.

Tool 10 permits a user to drive a rod into the ground by striking an end of a rod (such as end 62 of rod 60 in FIGS. 4, 5, 5A and 5B) with any of the first and second rod striking surfaces 42, 44 of the handle's 30 rod driving section 40 (or with alternate larger and stronger embodiment 40' shown in FIG. 5B) and the at least one striking face 22, 24 of the head. Again, in the embodiment of tool 10 shown in FIGS. 1—3, handle 30 is shown to connect with head 20 through a centrally located bore 26 in head 20. Handle end 36, being an end of the first, longer hollow handle section 32, is shown in the illustrated embodiment of FIG. 1 to be flush with a surface of head 20. Of course, the handle end could be partially through head 20 (not shown) or not through head 20 at all (also not shown), so long as head 20 has a corresponding bore hole to communicate a rod end (such as 62 in FIGS. 4, 5, 5A and 5B) therethrough to be struck by striking surface 42 of rod driving section 40. Head 20 is a sledge-like hammer head in the illustrated embodiment, thus having a first and a second striking face 22, 24, wherein the first striking face 22 is parallel with the second striking face 24. Striking face 22 is located at an opposite end of head 20 relative to the second striking face 24. Additionally, as connected, handle 30 has a major, or longitudinal axis that is substantially perpendicular to a major axis of the head 20.

In one embodiment, tool 10 is of affordable, all steel construction with welded connections, or joints, to provide a solid feeling, durable, one-piece tool. There are no separate pieces to be lost or misplaced by a worker. First and second hollow handle sections 32, 34 may be made from either pipe or tubular stock. Low carbon 1018 cold-rolled seemless tubing is one such example of tubular steel known to provide good strength and have good weld characteristics at an affordable price. The head can similarly be made from 1018 steel, as can rod-driving section 40 (or larger rod-driving section 40' shown in the alternate embodiment depicted in FIG. 5B). Head 20 can be of any suitable size and weight for driving a rod into the ground and for striking a rod end. An exemplary size for head 20 may be a sledge-like hammer head being 7 inches long by 3 inches high by 2 inches wide, and weighing about 11.5 pounds. Of course, this is just an example for the head dimensions and is not meant to limit the head or the present invention. Again, any suitable material, or combination of materials, can be used for the head 20, handle 30 and rod-driving section 40, such as other steels or even other metals, plastics, wood, fiberglass, and other composites. Alternatively, hollow handle section 32, 34 and rod driving section 40 can all be formed from one piece of solid bar stock of steel, or other metal. A machine could be used to bore and form the hollow sections 32, 34 of the handle 30, leaving a solid section 40 for rod driving on respective rod striking surfaces 42, 44. Furthermore, rod striking surfaces 42, 44 are shown as substantially flat surfaces for striking a rod end 62 (FIGS. 4 and 5). The chance of getting deformed rod ends 62 is minimized with the present inventive arrangement. Flat rod striking surfaces 42, 44 impacting with a rod end 62 (FIGS. 4 and 5) of a rod 60 having at least a section guided through hollow handle sections 32, 34, respectively, produces substantially square impacts that decreases the chance of deformed rod ends. Alternatively, rod striking surfaces 42, 44 may be concave, partially concave, or otherwise radiused inwardly (none of these configurations are shown) to help prevent deforming, or mushrooming, of the rod end 62.

A sledge hammer-like head, such as is shown in FIGS. 1–5 at 20, though not required by the present invention, is one embodiment of the present invention having multiple positive attributes. It not only provides two striking faces, such as 22, 24, but is symmetrical about the handle 30 in the connected position, thus providing good balance and feel to a user. Additionally, the user can use both hands to grip the tool 10 at head 20, such as during initial installation of a rod (such as 60 in FIGS. 4 and 5) using striking surface 42 with the rod 60 communicating through open end 36 of hollow handle section 32 (FIG.4).

The invention also pertains to a rod extractor tool 46 taking the form of a through hole 46, cross-wise through handle 30, having a diameter sized larger than a rod (such as 60 in FIGS. 4—6) to be extracted. Handle 30 size, extractor hole 46 placement along the length of handle 30 (between hollow handle sections 32, 34) and material properties may limit the size of rods to be extracted. For example in one embodiment, the extractor hole is 0.65 inches, and rod-driving section 40 through which extractor hole 46 is located, is 1.38 inches in diameter (about equal to the handle diameter) and made of 1018 steel. Long rods, including standard eight foot long electrical grounding rods of 0.625 inches in diameter can be effectively extracted with this tool embodiment. A stronger, larger rod driving section 40' can alternatively be used to provide a stronger extracting tool via hole 46 (FIG. 5B embodiment). Typical electrical grounding rods come in eight foot lengths and may be 0.500 or 0.625 inches in diameter. Some electrical grounding rods may be up to ten feet long and 0.750 inches in diameter. Rebar is often cut to desired lengths and can come in a variety of sizes, as well.

The extractor tool, or hole 46, may or may not be integral with rod-driving tool 10 as illustrated. All that is required is a long member (such as tool 10 and handle 30 —other possible embodiment, such as a dedicated extractor tool made from a long section of steel bar stock, are not shown) having a through-hole (such as 46) located along its length and between its two ends (such as 36, 38). The through hole must be larger in diameter than the diameter of the rod to be extracted and is slipped over the end of the rod. One end of the member is lifted while the other remains in contact with a pry surface, such as the ground. The rod is gripped and lifted. In the illustrated embodiments, hole 46 is located on the handle 30 of the manual, one-piece rod-driving tool 10, between the first and second hollow handle sections 32, 34. More specifically, through-hole 46 is in the solid rod-driving section 40 between ends 35, 37 of hollow handle sections 32, 34 respectively.

In one embodiment of rod-driving tool 10 with extractor hole 46 in handle 30, the first hollow handle section 32 is longer than the second hollow handle section 34. This permits a user to slide extractor hole 46 over an exposed rod end 62 and a portion of the rod 60 to be extracted (as in FIG. 6) and have a larger moment arm to assist in rod extraction by lifting the tool as at head 20 while opposite tool end near bore 38 remains in contact with a prying surface, such as the ground. The rod is gripped by the hole 46 during a lifting operation of the head 20 tool end relative to the tool end, near 38, and is extracted.

For strengthening purposes, and to protect tool 10 against damage induced by missed swings and erroneous impacts, an optional hosel, or collar or sleeve 50, is provided. Hosel 50 may take the form of a length of tubular or pipe stock steel, having an inside diameter to snugly fit over the outside diameter of handle 30, more specifically, snugly fitting over the hollow handle section 32 of handle 30. In the embodiment illustrated in FIGS. 1, 2 and 4, hosel 50 may be welded, plug-welded, or otherwise attached, at a first end to head 20 and at a second opposite end to handle 30 (as at an outer surface of hollow handle section 32). The hosel 50 weld connection creates a larger weld area to head 20 than simply welding smaller diameter handle 30 directly to head 20, as is shown in the embodiment depicted in FIG. 5 without an optional hosel. Of course, in embodiments where handle 30 is not metallic and instead made of wood, fiberglass, composite, or other suitable material, hosel 50 would not be welded to the handle 30. Hosel 50 could still be steel and welded to head 20, or could be made of another suitable material and bonded, such as by epoxy or glue, accordingly.

Additionally, methods are provided for installing and for extracting rods using tool 10. Referring now to FIGS. 4, 5, 5A and 5B, a worker can drive a rod into the ground using a tool 10, as described above, having a head 20 connected to a handle 30, the handle 30 having a first and a second hollow handle section 32, 34.

In one embodiment, as illustrated, hollow handle section 32 is connected with head 20 and is longer than hollow handle section 34. The head 20 forms one end of the tool with bore end 36 of the handle 30, while the other end of the tool is at handle 30 bore opening 38. Thus, the tool has two rod-receiving openings 36, 38 for communicating a portion of rod 60 through first and second hollow handle sections 32, 34 to be impacted by first and second driving means 42, 44, respectively. Of course, bore end 36 can be in the handle 30 end (as illustrated), or bore end 36 can be in head 20, in the case where handle 30 is connected to head 20 such that handle 30 only partially goes through head 20 or does not go through head 20 at all, so long as head 20 has an open bore end 36 for communicating a portion of a rod 60 through such that rod end 62 can be impacted by driving means, or rod striking surface 42 at the second end of hollow handle section 32.

To install a rod 60 using the illustrated embodiment of tool 10, the worker would guide a first end 62 of the rod 60 to be impacted and driven into a first open end 36 of the handle 30 of the tool 10, and slide a portion of rod 60 into the first hollow handle section 32, such that the first hollow handle section 32 surrounds a section of the rod 60. In the illustrated embodiment of tool 10, the head 20 resembles a sledge hammer head having two striking faces 22,24, and may be similarly weighted. The worker then places the other rod end 64 at the desired installation location and angle in contact with the ground while maintaining the first rod end 62 within the first hollow handle section 32 of the tool 10. The worker may grasp the head 20 or the handle 30 of tool 10 and lift tool 10 with respect to the rod 60 so that a portion of the first hollow handle section 32 still surrounds rod 60. Lifting the tool 10 with respect to the rod 60 in this inventive embodiment is relatively easy and controllable, since the head 20 forms the majority of the tool 10 overall weight and is near the worker's own head (worker not shown) when impacting the rod end 62 while vertically inserting an eight foot standard length grounding rod (such as 60 shown), for example. To drive rod 60, the worker then forcefully brings the tool 10 down so that the striking surface 42 located at the end of the first hollow section 32 within the handle 30 impacts the rod end 62, thereby driving the rod 60 into the ground. This process is repeated until the rod 60 is partially installed a first depth into the ground, as desired. The rod 60 can be inserted using the first drive means 42 such that the exposed portion of the rod 60 above ground surface level is limited by the length of the first hollow handle section 32. In addition, the rod 60 does not have to be driven vertically, as shown, but can be installed at an angle, as desired, by maintaining the tool 10 at the desired angle with rod 60, during installation.

At this point, the worker removes the tool 10 from surrounding engagement with the rod 60 by lifting tool 10 off partially installed rod 60. The worker then slides the second rod receiving, or bore opening 38 at the opposite handle end (opposite head 20 and bore 36 end) over the rod 60 so that a portion of the rod 60 is surrounded by the second hollow handle section 34. The worker can then hold the handle 30 or the head 20 of the tool 10, now with the head 20 at a vertically higher elevation of the tool 10 such that it is above the rod end 62 within the second hollow handle section 34 of the tool handle 30, and similarly drive the rod 60 with the corresponding striking surface 44 located at the end of the second hollow handle section 34 impacting the rod end 62. In this manner, the heavy head 20 of the tool 10 is at a manageable elevation, typically near or below a standing worker's head level when working with standard length eight foot rods (not shown). The worker can drive the rod 60 in this manner a second depth up to, or beyond, the limit of the second hollow handle section 34 hitting the ground. The second hollow handle section 34 can itself be driven, with the rod 60 into the ground to fully drive the rod 60, in some installations.

If needed, final installation of the rod 60 may be made with the tool 10 used as a conventional hammer, with the worker holding the tool 10 by gripping the handle 30 in the conventional manner, and swinging the head 20 down so that one of the striking faces 22, 24 impacts the rod end 62, thereby driving the rod 60 down into the ground (not shown). This is repeated until the rod end 62 is above, even with the ground level, or below grade, as desired. At such time, electrical grounding connections may be made, for example.

Figure 6:
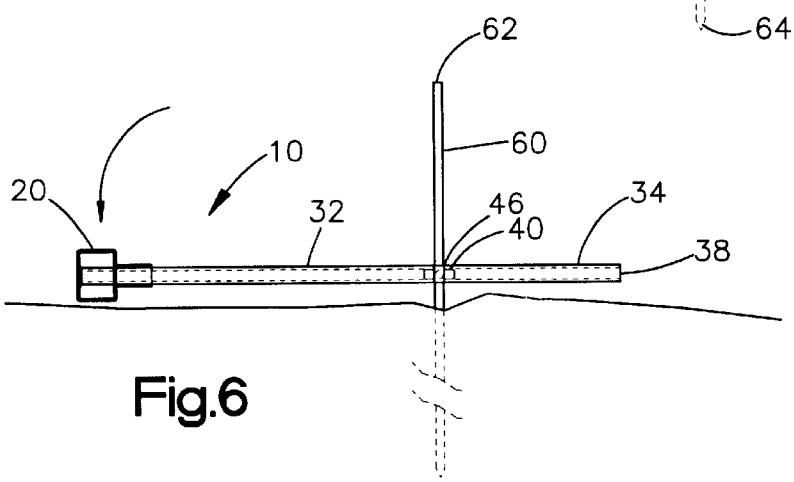
FIG. 6 illustrates use of an embodiment of the tool of the present invention to extract a partially installed rod.

Referring now to FIG. 6, in addition to installing rods, a method of extracting a rod 60 from the ground is disclosed herein. As may some times happen during a rod installation project, a subsurface blockage may be encountered that prevents further rod installation in a desired location or a partially installed rod is determined to be in the wrong location. In either case, this causes lost time in having to dig up the partially installed rod, or damage to the rod by the worker bending the rod back and for the to create a bigger hole thereby loosening the rod for easier manual extraction. Both situations are not desirable and are costly.

A tool is provided having an embodiment as shown in FIG. 6 at 10 for rod extraction of a partially inserted rod 60 having a rod section exposed above ground and a second buried section below ground level. In the illustrated embodiment, the rod extractor 46 is integral with the rod driving tool 10 and takes the form of a cross-wise hole 46 through the generally solid, rod driving section 40 of the handle 30, located between the first and second hollow handle sections 32, 34. Hole 46 is sized to be larger than the diameter of the rod to be extracted. To remove a partially installed rod 60, a worker turns the tool 10 horizontal and slides the extractor hole 46 of the tool 10 over the exposed rod end 62 of the partially installed rod 60 until the tool 10 is in contact with the ground at both the head 20 and opposite handle end (handle 30 end nearest bore opening 38, not specifically referenced). The user then lifts one end of the tool (either nearest 20 or nearest 38) with the other end (either 38 or 20, respectively) contacting the ground as a pry surface. The extractor hole 46 grips and lifts the rod 60. More specifically, the user lifts an end (such as 20) of the tool 10 from the starting elevation while maintaining the opposite tool end (such as 38) in contacting relation with the pry surface, such as the ground (as shown) or a board put under the tool end 38 contacting the pry surface (not shown), such that the rod 60 is simultaneously engaged by the through hole 46 at a lower hole edge closer to end 38 of the handle 30 and by an upper hole edge on an opposite handle side closer to the tool end 20 being lifted. The rod is typically extracted in this manner an incremental amount of the length disposed below ground level. As such, the process may have to be repeated to remove the rod as desired. In the embodiment of the tool 10 with the longer first hollow handle section 32 having an end connected with the head 20 and an extractor tool 46 interconnected between its other end (proximate bore opening 38) and a shorter second hollow handle section 34, extracting a rod 60 would preferably be done by lifting the head 20 end of the tool 10, thereby benefiting from the larger moment arm. Head 20 could be used to grip tool 10 during a rod 60 extraction, or a worker could grip the handle 30, or head 20 and handle 30, as desired.

As earlier described, an alternative embodiment could be a dedicated extractor tool (not shown) having an extractor hole (similar to 46) located between ends of a long member, such as a section of steel bar stock material. Sliding the extractor hole over the exposed end of the partially installed rod and lifting one tool end with respect to the other, to grip and lift the rod, would be similarly accomplished by a worker as already described.

Having thus described the invention, I claim:

1. A one-piece tool for driving a rod into the ground, comprising:

a head including at least one generally flat planar striking face for directly contacting and driving an end of the rod to be driven, the striking face having a surface area substantially larger than a surface area of the end of the rod to be driven;

a handle fixedly connected to the head at a first handle end such that the head and the handle are immovable with respect to each other, the head and handle forming a hammer wherein the striking face is substantially parallel to a major axis of the handle, the handle including a first hollow section, a second hollow section, and a rod driving section having a first and a second rod striking surface, the first rod striking surface disposed at an end of the first hollow section and the second rod striking surface disposed at an end of the second hollow section, the rod driving section interposed between the first and second hollow sections, the first and second hollow sections for guiding at least a portion of the rod to be driven; and first and second rod-receiving openings, each located at a respective tool end, the first rod receiving opening for communicating at least a portion of the rod to be driven through the first hollow section to be directly contacted and driven by the first rod striking surface of the rod driving section, the second rod receiving opening for communicating at least a portion of the rod to be driven through the second hollow section to be directly contacted and driven by the second rod striking surface of the rod driving section, whereby an end of the rod to be driven into the ground can be directly contacted and driven by each of the first and second rod striking surfaces of the rod driving section and the at least one striking face of the head, wherein the tool further comprises a rod extractor, the rod extractor comprising a through-hole in the rod driving section of the handle, the through-hole of a diameter larger than the diameter of the rod.

2. A tool for driving a rod into the ground, the tool comprising a handle and a head forming the majority of the weight of the tool, the head being connected to the handle thereby forming a hammer for striking the rod, the handle defining a head end and a remote end, the head being connected to the handle at the head end of the handle, the head end of the handle defining a first rod-receiving opening terminating in a first rod striking surface the remote end of the handle defining a second rod-receiving opening terminating in a second rod striking surface, the first rod-receiving opening being longer than the second rod-receiving opening, wherein the head defines a third rod striking surface and further wherein the head is connected to the handle so that the head and handle are immobile with respect to one another as the tool is moved for striking the rod with each rod striking surface.

3. The tool of claim 2, wherein the head is rigidly mounted to the handle.

4. The tool of claim 3, wherein the first rod striking surface is closer to the remote end of the handle than to the head end of the handle.

5. The tool of claim 4, wherein the tool is a one-piece tool.

6. The tool of claim 3, wherein the tool is a one-piece tool.

7. The tool of claim 2, wherein the first rod striking surface is closer to the remote end of the handle than to the head end of the handle.

8. The tool of claim 7, wherein the tool is a one-piece tool.

9. The tool of claim 2, wherein the head is a weighted sledge hammer-like head, and includes a first and a second striking face, the first striking face being parallel with the second striking face and at an opposite end of the head relative to the second striking face, and wherein the handle is connected to the head such that a major axis of the handle is substantially perpendicular to a major axis of the head.

10. The tool of claim 2, wherein the handle comprises a tubular material.

11. The tool of claim 2, wherein the head and handle are made from a steel.

12. The tool of claim 2, further comprising a rod extractor, the rod extractor comprising a through-hole in the rod driving section of the handle, the through-hole having a diameter larger than the diameter of the rod.

13. The tool of claim 12, wherein the first and second rod striking surfaces are arranged in the handle and define therebetween a rod driving section, the through hole being defined in the rod driving section.

14. The tool of claim 2, wherein the rod is an electrical grounding rod having a diameter of from about 0.5 inches to about 0.75 inches.

15. The tool of claim 2, wherein the head end of the handle is substantially flush with a surface of the head.

16. The tool of claim 2, further comprising a hosel, the hosel connected at a first end to the head and connected at a second end to an outer surface of the handle.

17. The tool of claim 16, wherein the handle is tubular, and wherein the handle is connected to the head through a bore in the head such that head end of the handle is substantially flush with a surface of the head.

* * * * *